United States Patent [19]

Wallén

[11] 4,101,316

[45] Jul. 18, 1978

[54] CONVERSION OF MOLYBDENITE CONCENTRATE TO FERRO-MOLYBDENUM AND SIMULTANEOUS REMOVAL OF IMPURITIES BY DIRECT REDUCTION WITH SULFIDE FORMING REDUCING AGENTS

[75] Inventor: Jan Wallén, Trollhattan, Sweden

[73] Assignee: Ferrolegeringar Trollhatteverken AB, Trollhattan, Sweden

[21] Appl. No.: 786,013

[22] Filed: Apr. 8, 1977

[30] Foreign Application Priority Data

Apr. 14, 1976 [SE] Sweden ..... 76044437

[51] Int. Cl.[2] ..... C22C 1/02

[52] U.S. Cl. ..... 75/129; 75/84

[58] Field of Search ..... 75/129, 10 R, 176, 84

[56] References Cited

U.S. PATENT DOCUMENTS

| | | | |
|---|---|---|---|
| 3,020,151 | 2/1962 | Nachtman | 75/10 R |
| 3,146,093 | 8/1964 | Foos | 75/84 |
| 3,865,573 | 2/1975 | Neumann | 75/84 |
| 3,907,554 | 9/1975 | Boaden | 75/129 |
| 3,966,459 | 6/1976 | Buker | 75/84 |

*Primary Examiner*—P. D. Rosenberg

*Attorney, Agent, or Firm*—Watson, Leavenworth, Kelton & Taggart

[57] ABSTRACT

Copper containing molybdenite concentrates are reduced in a ferro-manganese melt or a melt of ferro-manganese and iron to produce a molybdenum-iron material having significantly low copper and sulfur content therein.

8 Claims, No Drawings

CONVERSION OF MOLYBDENITE CONCENTRATE TO FERRO-MOLYBDENUM AND SIMULTANEOUS REMOVAL OF IMPURITIES BY DIRECT REDUCTION WITH SULFIDE FORMING REDUCING AGENTS

The present invention relates to the production of ferro-molybdenum from molybdenite concentrate, particularly from copper-bearing molybdenum concentrates.

In the production of molybdenite concentrate from molybdenum ores derived from deposits containing copper and molybdenum minerals, a complete separation of the copper and molybdenum mineral cannot always be obtained. In the present manufacturing process for ferro-molybdenum, the molybdenite concentrate is roasted with air or oxygen, whereafter the commercial molybdenum oxide obtained is used in steel production directly or after metallo-thermic reduction (e.g. with ferro-silicon) to ferro-molybdenum. In both cases the copper content of the concentrate remains unaffected, i.e. the copper accompanies the molybdenum oxide or ferro-molybdenum, which is a drawback in their use for the production of steel. It is normally required that the ferro-molybdenum shall contain a maximum copper content, often 0.5% copper.

Sulfur dioxide is generated during roasting of the molybdenite concentrate, which creates difficult environmental problems.

The present invention is directed towards removing or reducing these difficulties by providing a process in which roasting is completely or partly eliminated, and the majority of the sulfur as well as copper which is possibly present is transferred to a sulfide-bearing slag.

This is achieved according to the invention in that molybdenum sulfide in the molybdenite concentrate is reduced directly with the help of a melt of ferro-manganese or a mixture of ferro-manganese and iron in such a way that partly there is formed a metal phase mainly consisting of ferro-molybdenum purified from copper and sulfur, and partly a slag phase mainly consisting of manganese sulfide, the latter containing the majority of the copper which is possibly present. The manganese sulfide obtained has commercial utilisation possibilities as an additive in the manufacture of certain kinds of steel.

The process according to the invention is suitably carried out by melting ferro-manganese or a mixture of ferro-manganese and iron in an electric arc furnace, induction furnace, or converter having a refractory lining, whereafter the molybdenite concentrate is introduced. The iron content should be kept at a level such that the slag phase as well as the metal phase can be tapped without difficulty from the furnace after completed reaction. The furnace or the converter is suitably so formed that the concentrate can be introduced in the form of a suspension in a gas. The refractory liner of the furnace suitably consists of alumina.

Baths of iron, manganese and molybdenum contain a certain amount of carbon, which varies according to the choice of raw material, and especially the choice of ferro-manganese quality. An oxidising agent can be added simultaneously with or after adding the molybdenite concentrate, to reduce the carbon content in the bath. The oxidising agent can consist of molybdenum oxide (roasted molybdenite concentrate) or iron ore concentrate. Alternatively, decarburization can be carried out using air or oxygen.

If required, further reducing agents, e.g. finely divided carbon, can be added simultaneously with or after the addition of concentrate or oxidising agent.

The invention is illustrated by the following examples.

EXAMPLE 1

Molybdenite concentrate reduction experiments with ferro-manganese were carried out in a small induction furnace with graphite or combined magnesite and graphite crucibles. The furnace rating was about 27 kVA at a frequency of 3400 Hz with a melting capacity of up to some kilogrammes.

Tests were carried out with four different molybdenite concentrates containing (a) 55.3% Mo, 0.38% Cu, 0.024% Pb, (b) 56.4% Mo, 0.44% Cu, 0.019% Pb, (c) 56.4% Mo, 0.03% Cu, 0.080% Pb and (d) 56.0% Mo, 0.68% Cu, 0.040% Pb. The reducing agent used was ferro-manganese containing 77.5% Mn, 6.8% C, and 0.75% Si, by itself or in combination with iron in the form of scrap (tests 3 – 6 and 9) or iron ore concentrate containing 69.6% Fe and 0.60% $SiO_2$ (tests 7 and 8).

In test 1, the ferro-manganese material was mixed with the molybdenite concentrate, small briquettes (diameter 50 mm, height 30 mm) being subsequently produced from the mixture. The briquettes were melted in a graphite crucible.

In test 2, the briquettes were prepared in the same way as in test 1. A liner of magnesite was used to eliminate possible influence of the crucible material. Due to the reaction between the slag and the magnesite liner the slag could not be weighed.

In test 3, the ferro-manganese and iron scrap were melted in a magnesite crucible, whereafter the briquetted molybdenite concentrate was added. The slag reacted with the crucible material in this case as well.

In test 4, a mixture of the ferro-manganese and concentrate was briquetted. Iron scrap and half of the briquette material was melted in a magnesite crucible and the rest of the briquettes was added. The slag reacted with the crucible in this case also.

In test 5, the iron scrap and the briquetted mixture of ferro-manganese and concentrate was melted together in the crucible, which was made from graphite, as in tests 6 – 9.

Test 6 was carried out according to the same method as test 4 but in a graphite crucible.

In test 7, the iron ore concentrate was melted in powder form together with briquettes of ferro-manganese and molybdenite concentrate.

In test 8, the iron ore concentrate was mixed with the other ingredients and the mixture was briquetted and melted.

In test 9, all the ingredients were melted together in the crucible.

Other details of the test and the results obtained are apparent from table I.

Further tests using oxygen blowing were carried out on the metals obtained in test 4. The slag from the reduction step was removed and replaced with a strongly basic slag. Oxygen was introduced through an aluminium oxide lance having an inside diameter of 2 mm at its tip. After blowing the metal contained 53.0% Mo, 41.0% Fe, 5.0% Mn, 0.026% C, 0.063% S. The tests show that by reducing molybdenite concentrate with ferro-manganese it is possible to obtain a metal phase with 50–60% molybdenum, a manganese content of 5% (which can be reduced by using iron ore concentrate as a source of iron) a copper content under 0.05%, a carbon content of about 5% (which can be reduced by oxygen blowing) and a sulfur content under 0.1%.

EXAMPLE 2

Tests similar to those in example 1 were carried out in graphite crucibles. Two different molybdenite concentrates were used containing (e) 53.4% Mo, 0.16% Cu, 0.008% Pb, (f) 46.6% Mo, 1.12% Cu, 0.028% Pb. Two kinds of ferro-manganese were used containing (I) 77.5% Mn, 6.8% Cu, 0.75% Si, and (II) 76.5% Mn, 6.85% Cu, 0.10% Si. In all the tests, the materials were mixed and briquetted, then introduced and melted in the crucible, the charge being stirred for some minutes.

The results are apparent from table II.

Fe, 1.22% Cu, 0.007% Pb and ferro-manganese containing 77.3% Mn, 6.9% C, 1.0% Si. The materials were mixed in a rod mill before they were introduced into the furnace.

In all the tests an easily flowing slag was formed as well as a viscous metal layer after the mixture had been introduced. In the first test the slag was tapped off and the metal allowed to cool, to be later broken out of the furnace. In subsequent tests the slag was tapped off, and thereafter a slag of lime with 10% fluorspar was added, whereon the furnace was reheated. The metal then melted and could be tapped off. When oxygen blowing was carried out, this took place after melting the second slag. The oxygen was blown towards the metal surface.

Table III shows the composition of the starting mixture and analyses for the metal without oxygen blowing and for the slag.

Table IV shows results of oxygen blowing.

Table I

| Starting materials | | | | | Metal phase | | | | | | | | |
|---|---|---|---|---|---|---|---|---|---|---|---|---|---|
| Test | Weight g | $MoS_2$-conc. Type | FeMn g | Iron g | Weight g | Mo % | Fe % | Mn % | Cu % | Si % | C % | S % | Pb % |
| 1 | 125 | a | 100 | — | 96 | 72.4 | 15.2 | 3.14 | 0.04 | — | 4.55 | 0.5 | 0.002 |
| 2 | 167 | a | 133 | — | 123 | 71.0 | 14.0 | 5.0 | — | — | 4.40 | 0.58 | — |
| 3 | 390 | b+c 50:50 | 353 | 82.4 | 355 | 38.0 | 27.0 | 22.0 | 0.05 | — | 6.15 | 0.063 | — |
| 4 | 390 | " | 353 | 82.4 | 298 | 52.0 | 31.0 | 8.0 | — | — | 4.05 | 0.081 | — |
| 5 | 534 | " | 496 | 100.6 | 550 | 55.1 | 27.5 | 7.4 | 0.03 | — | 5.45 | 0.096 | <0.001 |
| 6 | 1064 | " | 990 | 200.7 | 996 | 54.7 | 27.7 | 6.2 | 0.03 | — | 5.60 | 0.091 | <0.001 |
| 7 | 534 | " | 496 | 139.7 | 480 | 61.7 | 30.0 | 1.9 | 0.03 | 0.15 | 4.90 | 0.42 | — |
| 8 | 534 | d | 495 | 139.7 | 497 | 60.0 | 32.5 | 1.5 | 0.03 | — | 4.30 | 0.23 | <0.001 |
| 9 | 531 | " | 493 | 100.0 | 546 | 55.0 | 30.2 | 6.2 | 0.04 | — | 5.40 | 0.087 | <0.001 |
| | | | | | Slag phase | | | | | | | | |
| 1 | | | | | 117 | 0.13 | 1.56 | 61.0 | 0.36 | — | — | 33.4 | 0.001 |
| 2 | | | | | — | 0.1 | 1.0 | 47.0 | — | — | — | 28.6 | — |
| 3 | | | | | — | 2.2 | 1.0 | 23.0 | 0.1 | — | — | 10.2 | — |
| 4 | | | | | — | 1.1 | 1.2 | 36.0 | — | — | 0.12 | 15.8 | — |
| 5 | | | | | 559 | 0.06 | 1.5 | 61.0 | 0.20 | — | 0.056 | 34.0 | — |
| 6 | | | | | 864 | 0.17 | 1.6 | 61.0 | 0.22 | — | 0.082 | 36.7 | — |
| 7 | | | | | 640 | 0.12 | 3.7 | 62.9 | 0.16 | 1.44 | 0.10 | 29.8 | — |
| 8 | | | | | 623 | 0.16 | 2.0 | 63.0 | 0.5 | — | 0.14 | 31.0 | — |
| 9 | | | | | 546 | 0.08 | 0.5 | 59.7 | 0.4 | — | 0.13 | 34.4 | — |

Table II

| | | | | | | | Metal phase | | | | | | |
|---|---|---|---|---|---|---|---|---|---|---|---|---|---|
| Test | Weight g | $MeS_2$-conc. | Weight g | FeMn | Iron ore g | $MnO_2$ | Weight g | Mo % | Fe % | Mn % | C % | Cu % | S % |
| 1 | 850 | f | 634 | I | 196 | — | 580 | 67.1 | 27.5 | 0.71 | 3.70 | 0.06 | 0.07 |
| 2 | 900 | " | 670 | II | 210 | — | 616 | 67.4 | 26.4 | 0.94 | 4.25 | 0.06 | 0.75 |
| 3 | 568 | e | 463 | II | 149 | — | 450 | 64.9 | 29.0 | 0.72 | 3.65 | 0.02 | 0.40 |
| 4 | 570 | e | 465 | II | 150 | 11 | 397 | 63.6 | 29.1 | 1.7 | 4.10 | 0.02 | 0.78 |
| 5 | 570 | " | 465 | II | 150 | — | 466 | 65.5 | 28.7 | 0.8 | 3.60 | 0.01 | 0.64 |
| 6 | 645 | f | 480 | II | 147 | 11 | 340 | 64.7 | 29.9 | 0.6 | 3.45 | 0.05 | 0.62 |
| 7 | 645 | " | 480 | II | 147 | 11 | 452 | 65.4 | 29.6 | 0.7 | 3.75 | 0.06 | 0.58 |
| | | | | | | | Slag phase | | | | | | |
| | | | | | | | Weight g | Mo % | Fe % | Mn % | C % | S % | |
| 1 | | | | | | | 1025 | 0.34 | 9.4 | 47.9 | 0.08 | 28.0 | |
| 2 | | | | | | | 1084 | 0.16 | 10.7 | 46.2 | 0.05 | 26.1 | |
| 3 | | | | | | | 630 | 0.19 | 4.8 | 56.0 | 0.31 | 31.8 | |
| 4 | | | | | | | 180 | <0.1 | 4.6 | 50.9 | 1.10 | 34.0 | |
| 5 | | | | | | | 656 | <0.1 | 7.8 | 52.9 | 0.11 | 32.0 | |
| 6 | | | | | | | 863 | 4.6 | 9.0 | 43.8 | 0.35 | 23.2 | |
| 7 | | | | | | | 761 | <0.2 | 8.7 | 50.3 | 0.11 | 29.8 | |

EXAMPLE 3

Tests were carried out in a 70 kW electric arc furnace using a $MoS_2$-concentrate containing 52.1% Mo, 1.62%

Table III

| | | | | | | | | Metal | | | | | |
|---|---|---|---|---|---|---|---|---|---|---|---|---|---|
| Test | $MoS_2$ | FeMn | Addition (kg) scale | Fe | Furnace lining | Melting time (min) | Energy kWH | Weight kg | Mo % | Mn % | C % | S % | Cu % |
| 1 | 8.90 | 6.88 | 2.29 | — | Coal | 20 | 14 | 6.92 | 53.5 | 4.4 | 4.37 | 0.26 | 0.16 |
| 2 | 8.08 | 6.35 | 2.14 | — | " | 35 | 29 | 5.3 | 61.1 | 3.2 | 5.5 | 0.06 | 0.14 |
| 3 | 8.08 | 6.35 | — | 1.55 | " | 35 | 30 | 5.89 | 60.5 | 7.3 | 5.85 | 0.04 | 0.18 |

Table III-continued

| | | | | | | | | | | | | | |
|---|---|---|---|---|---|---|---|---|---|---|---|---|---|
| 4 | 8.08 | 6.35 | 2.14 | — | " | — | — | — | 55.6 | 3.22 | 4.60 | 0.37 | 0.18 |
| 5 | 8.08 | 6.35 | 2.14 | — | Tecn. magnesia | — | — | 5.87 | 62.4 | 2.23 | 4.05 | 0.03 | 0.11 |
| 6 | 8.08 | 6.35 | 2.14 | — | " | — | — | — | 62.8 | 6.04 | 4.50 | 0.90 | 0.16 |
| 7 | 8.10 | 6.2 | 3.4 | — | " | — | — | — | 66.7 | 0.65 | 3.65 | 0.62 | 0.11 |

| | Slag | | | | | |
|---|---|---|---|---|---|---|
| | Weight kg | Mo % | Mn % | S % | Cu % | Fe % |
| 1 | 6.86 | 0.5 | 52.3 | 27.1 | — | — |
| 2 | 9.50 | 0.22 | 50.9 | 30.8 | 1.38 | 7.7 |
| 3 | — | 0.20 | 44.4 | 30.4 | 1.13 | — |
| 4 | 8.60 | 0.27 | 50.4 | 30.9 | 1.22 | 6.7 |
| 5 | 8.85 | 0.40 | 51.8 | 31.7 | 0.82 | 6.4 |
| 6 | 8.66 | 1.33 | 32.8 | 17.3 | 0.38 | 7.7 |
| 7 | 12.54 | 1.12 | 37.4 | 20.4 | 0.04 | 13.2 |

Table IV

| | Metal after blowing | | | | | | | | |
|---|---|---|---|---|---|---|---|---|---|
| Test | Weight kg | Mo % | Mn % | C % | S % | Cu % | Blowing time (min) | Total time (min) | Total energy (kWH) |
| 4 | 5.27 | 59.7 | 3.33 | 5.65 | 0.03 | 0.14 | 7 | 63 | 38 |
| 6 | 5.42 | 58.7 | 1.20 | 3.65 | 0.13 | 0.20 | 7 | 39 | 21 |
| 7 | 2.07 | 69.4 | 0.15 | 0.12 | 0.14 | 0.12 | 8 | 43 | 52 |

I claim:

1. A process for reducing copper-containing molybdenite concentrates comprising effecting the reduction of the molybdenite concentrate in one of a ferro-manganese melt and a melt of ferro-manganese and iron thereby to form a manganese - sulfur - and copper bearing slag phase and a metal phase containing molybdenum and iron.

2. A process, as claimed in claim 1, characterized in that the reduction operation takes places in an electrically heated refractory lined furnace unit and the iron content is maintained at a level facilitating tapping of the slag phase and metal phase from the furnace without difficulty.

3. A process, as claimed in claim 2, characterized in that the furnace unit is a converter, the addition of concentrate thereto being in the form of a suspension of the concentrate in a gas.

4. A process, as claimed in claim 2, characterized in that the refractory lining consists of alumina.

5. A process, as claimed in claim 2, characterized in that simultaneously with or after adding the concentrate, further addition of reducing agent takes place.

6. A process, as claimed in claim 5, characterized in that the reducing agent consists of finely divided carbon.

7. A process, as claimed in claim 2, characterized in that a final adjustment of the carbon content in the metal obtained is effected by addition of an oxidizing agent.

8. A process, as claimed in claim 7, characterized in that the oxidising agent consists of molybdenum oxide.

* * * * *

UNITED STATES PATENT AND TRADEMARK OFFICE

CERTIFICATE OF CORRECTION

PATENT NO. : 4,101,316

DATED : July 18, 1978

INVENTOR(S) : Jan Wallen

It is certified that error appears in the above-identified patent and that said Letters Patent are hereby corrected as shown below:

At Col. 4, Table II, heading of third column should read --$MoS_2$-Conc.--.

At Col. 4, Table II, last column thereof, under the heading "S %", the first entry should read --0.70--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*